US008991972B2

(12) United States Patent
Tanaka

(10) Patent No.: US 8,991,972 B2
(45) Date of Patent: Mar. 31, 2015

(54) LIQUID EJECTING APPARATUS AND MAINTENANCE METHOD

(75) Inventor: Takeshi Tanaka, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 152 days.

(21) Appl. No.: 13/296,380

(22) Filed: Nov. 15, 2011

(65) Prior Publication Data

US 2012/0120140 A1 May 17, 2012

(30) Foreign Application Priority Data

Nov. 17, 2010 (JP) ..... 2010-256552
Nov. 17, 2010 (JP) ..... 2010-256553

(51) Int. Cl.
*B41J 2/125* (2006.01)
*B41J 2/165* (2006.01)
*B41J 2/175* (2006.01)
*B41J 29/02* (2006.01)

(52) U.S. Cl.
CPC *B41J 2/125* (2013.01); *B41J 2/165* (2013.01); *B41J 2/17509* (2013.01); *B41J 29/02* (2013.01)
USPC ..... 347/23; 347/108

(58) Field of Classification Search
USPC ..... 347/14, 108; 33/391, 24.2
See application file for complete search history.

(56) References Cited

U.S. PATENT DOCUMENTS

2001/0024586 A1* 9/2001 Day et al. ..... 400/88
2009/0143960 A1* 6/2009 Matsumoto ..... 701/109
2011/0012953 A1 1/2011 Nakamura

FOREIGN PATENT DOCUMENTS

JP 2002-210927 7/2002
JP 2005-271384 10/2005

OTHER PUBLICATIONS

Machine English Translation of JP 2006-90796.*
Machine English Translation of JP 2002-210927.*

* cited by examiner

*Primary Examiner* — Julian Huffman
*Assistant Examiner* — Sharon A Polk
(74) *Attorney, Agent, or Firm* — Workman Nydegger

(57) ABSTRACT

A movable member configured to move when a liquid ejecting apparatus is inclined from a posture to be taken when ejecting liquid upon receipt of an action of the gravitational force and a memory unit configured to store the fact that the movable member is moved in response to abutment with the moved movable member are provided and the presence or absence of the movement of the movable member is acquired after the power has been turned ON. Accordingly, a change of the posture of the liquid ejecting apparatus in a power OFF state can be determined after the fact after the power has been turned ON.

3 Claims, 9 Drawing Sheets

FIG. 6

| | |
|---|---|
| MAINTENANCE A | 1. FLASHING<br>2. WEAK SUCTION<br>3. WIPING |
| MAINTENANCE B | 1. WIPING<br>2. STRONG SUCTION<br>3. FLASHING<br>4. WEAK SUCTION<br>5. WIPING |

LIQUID EJECTING APPARATUS AND MAINTENANCE METHOD

CROSS-REFERENCE TO RELATED APPLICATIONS

The entire disclosure of Japanese Patent Application No. 2010-256552, filed Nov. 17, 2010 and No. 2010-256553, filed Nov. 17, 2010, is expressly incorporated by reference herein.

BACKGROUND

1. Technical Field

The present invention relates to a technology for ejecting liquid from an ejection head.

2. Related Art

A liquid ejecting apparatus configured to eject liquid such as ink from an ejection head having minute ejection nozzles is known. Such a liquid ejecting apparatus is generally designed so as to eject liquid from ejection nozzles onto a printing medium such as a printing sheet while transporting the printing medium in the horizontal direction. Therefore, components which constitute the liquid ejecting apparatus are arranged horizontally, and hence the liquid ejecting apparatus requires a large surface area for installation. Accordingly, a configuration in which liquid is ejected onto the printing medium while transporting the medium in the vertical direction (so-called, vertical type) has been employed. When the liquid ejecting apparatus is of the vertical type, the components of the liquid ejecting apparatus can be arranged in the vertical direction. Therefore, reduction of the surface area for installation of the liquid ejecting apparatus is achieved.

However, the probability of falling over of the liquid ejecting apparatus increases with a decrease in surface area for installation. In the case of a normal liquid ejecting apparatus which is not of the vertical type, the posture of the liquid ejecting apparatus is changed from the normal posture (the posture taken when ejecting liquid) while being carried. When the posture of the liquid ejecting apparatus is changed from the normal posture, the state of the ejection head may change. Therefore, a configuration in which detection of the inclination of the liquid ejecting apparatus is enabled using an acceleration sensor attached to the liquid ejecting apparatus (JP-A-2005-271384), and maintenance of the ejection head is performed when it is determined that the liquid ejecting apparatus has fallen from an output from the acceleration sensor has been contemplated.

However, the change in posture of the liquid ejecting apparatus may occur not only in a state in which electric power is supplied to the liquid ejecting apparatus (that is, when the power is ON), but also in a state in which the electric power supplied to the liquid ejecting apparatus is shut down (when the power is OFF). Since the acceleration sensor cannot be used in the state in which the power is OFF, there arises a problem that determination of whether or not the posture of the liquid ejecting apparatus has changed from the normal posture during the period when the power was OFF cannot be performed.

SUMMARY

An advantage of some aspects of the invention is that a technology is provided that determines the presence or absence of a posture change of a liquid ejecting apparatus when the power is OFF.

In order to solve at least part of the above-described problem, the liquid ejecting apparatus in the invention employs the following modes. According to a first aspect of the invention, there is provided a liquid ejecting apparatus configured to eject ink from an ejection nozzle including: a movable member provided so as to be movable with respect to the liquid ejecting apparatus and configured to move when the liquid ejecting apparatus is inclined by an action of the gravitational force from a posture taken when ejecting the liquid; and a memory unit configured to store the fact that the movable member has moved in response to abutment with the moved movable member.

In the liquid ejecting apparatus of the invention configured as described above, when the liquid ejecting apparatus is inclined from a posture taken when ejecting liquid, the movable member is moved by the gravitational force, and the fact that the movable member has moved is stored in response to abutment of the movable member with the memory unit.

Accordingly, the fact that the movable member has moved can be stored by bringing the movable member into abutment with the memory unit using a gravitational force, and thus the fact that the movable member has moved can be stored without utilizing electric energy. Accordingly, the fact that the liquid ejecting apparatus has inclined in a state in which electric power is not supplied (the power OFF state) can be stored in the memory unit. Therefore, an operator can determine whether or not the liquid ejecting apparatus has moved when the power is OFF by referencing stored contents. Consequently, the operator can determine whether or not the maintenance of an ejection head should be performed. In addition, by providing a mechanism for referencing the stored contents in the memory unit in the liquid ejecting apparatus, whether or not the liquid ejecting apparatus has been inclined when the power is OFF can be determined on the side of the liquid ejecting apparatus on the basis of the referenced result, so that whether or not the maintenance of the ejection head should be performed can be determined on the side of the liquid ejecting apparatus.

In this case, the memory unit may have a configuration in which a member coming into abutment with the movable member is moved.

In this configuration, when the movable member comes into abutment with the memory unit, the member on the side of the memory unit is moved by an external force from the movable member. Therefore, whether or not the movable member and the memory unit have come into abutment with each other (that is, whether or not the liquid ejecting apparatus has been inclined) can be determined depending on whether or not the member on the side of the memory unit has moved. Examples of "the member which has come into abutment with the movable member is moved" includes "the member having collided with the movable member is moved by being bounced off" and "the position of a different member with respect to a base member is moved by an action of an external force from the movable member exerted on the different member mounted on the basic member".

In this case, the memory unit may have a configuration in which a member coming into abutment with the movable member is deformed.

In this configuration, when the movable member comes into abutment with the memory unit, the member on the side of the memory unit is deformed by an external force from the movable member. Therefore, whether or not the movable member and the memory unit have come into abutment with each other (that is, whether or not the liquid ejecting apparatus has been inclined) can be determined depending on whether or not the member on the side of the memory unit has deformed. Examples of "the member having come into abutment with the movable member is deformed" includes "the shape of a member itself is deformed upon receipt of a pressure like a rubber-made member" and "the portion of the member to be pressed (the portion of a button) itself is not changed but the entire shape is deformed by the portion of the button having been pushed in like a switch".

In this case, the memory unit may have a configuration in which the movable member and a member with which the movable member coming into abutment with are attracted to each other.

In this configuration, when the movable member comes into abutment with the memory unit, the movable member and the member on the side of the memory unit are attracted to each other. Therefore, whether or not the movable member and the memory unit have come into abutment with each other (that is, whether or not the liquid ejecting apparatus has been inclined) can be determined depending on whether or not the movable member and the member on the side of the memory unit are in the state of being attracted to each other. Examples of "the movable member and the member coming into abutment with the movable member are adhered to each other" includes, for example, "attracted by magnetic force" and "attracted by a suction force of a suction cup".

In this case, the movable member may be a member whose amount of movement changes when moving along a route of movement of the movable member in accordance with the magnitude of inclination of the liquid ejecting apparatus, and the memory unit may be a unit to be provided at a plurality of positions on the route of movement of the movable member.

In this configuration, the magnitude of inclination of the liquid ejecting apparatus when inclined when the power is OFF can be stored by storing the amount of movement of the movable member. Depending on the inclination of the liquid ejecting apparatus, the extent of change generated in the ejection head may be different. Therefore, by determining the extent of inclination of the liquid ejecting apparatus when the power is OFF from the contents stored in the memory unit, an adequate maintenance depending on the extent of change in the state of the ejection head is achieved.

In this case, the movable member is configured to move along any one of a predetermined plurality of route of movement, and the route of movement along which the movable member moves is determined from a plurality of route of movement in accordance with the direction of inclination of the liquid ejecting apparatus. The memory unit may be provided on each of the plurality of route of movement.

In this configuration, the direction of inclination of the liquid ejecting apparatus when inclined when the power is OFF can be stored by storing the route of movement along which the movable member has moved. Although described in detail later, the extent of the change of state generated in the ejection head may vary with the direction in which the liquid ejecting apparatus has inclined depending on the configuration of the liquid ejecting apparatus. Therefore, by determining the direction of inclination of the liquid ejecting apparatus when the power is OFF from the contents stored in the memory unit, an adequate maintenance depending on the extent of change in the state of the ejection head is achieved.

In this case, a reset unit configured to initialize contents stored in the memory unit may be provided.

In this configuration, the stored contents in the memory unit may be initialized when the fact that the movable member has moved does not have to be stored any longer. Therefore, when the liquid ejecting apparatus gets into the power OFF state for the next time, the fact that the movable member has moved can be stored using the memory unit.

In this case, a determining unit configured to determine whether or not the movable member has moved by acquiring the stored contents of the memory unit after the power of the liquid ejecting apparatus has been turned ON may be provided.

In this configuration, the fact that the liquid ejecting apparatus has been inclined from the posture taken when ejecting liquid in the state in which electric power is not supplied (the power OFF state) can be detected after the fact (after the power has been turned ON) depending on the presence or absence of the movement of the movable member. Therefore, for example, the fact that the result of detection can be displayed on a liquid crystal display of the liquid ejecting apparatus to notify the same to a user thereby causing the user to perform the maintenance of the ejection head as needed.

In this case, a maintenance unit of the liquid ejecting apparatus may be activated to execute a maintenance operation on the ejection head when it is determined that the movable member has moved after the power has been turned ON.

In this configuration, the maintenance operation of the ejection head can be performed automatically after the power has been turned ON on the basis of the fact that the movable member has moved when the power is OFF (the fact that the liquid ejecting apparatus has inclined from the posture taken when ejecting liquid). Consequently, the maintenance operation can be executed reliably on the ejection head having a need for the maintenance depending on the change of the posture of the liquid ejecting apparatus when the power is OFF.

In this case, the direction of movement when the movable member has moved may be stored so as to determine the direction of movement after the power has been turned ON.

In this configuration, the direction of inclination of the liquid ejecting apparatus from the posture taken when ejecting liquid when the power is OFF can be detected after the power has been turned ON on the basis of the direction of movement of the movable member. Although described in detail later, the extent of the change of state generated in the ejection head may be different depending on the direction in which the liquid ejecting apparatus has inclined. Therefore, by enabling the detection of the direction of inclination of the liquid ejecting apparatus, an adequate maintenance depending on the extent of change in the state of the ejection head is achieved even when the posture of the liquid ejecting apparatus is inclined when the power is OFF.

In this case, when the direction of movement of the movable member is determined after the power has been turned ON, the maintenance unit of the liquid ejecting apparatus may be activated for executing the predetermined maintenance operation for the ejection head depending on the direction of movement of the movable member.

As described above, the extent of the change of state generated in the ejection head may be different depending on the direction in which the posture of the liquid ejecting apparatus has been inclined. Therefore, by executing the predetermined maintenance operation depending on the direction of movement of the movable member (the direction of inclination of the liquid ejecting apparatus), even when the posture of the liquid ejecting apparatus is inclined when the power is OFF, an adequate maintenance can be executed depending on the extend of change of the state of the ejection head. Since the maintenance operation is performed automatically after the power has been turned ON, the maintenance operation can be executed reliably on the ejection head having a need for the maintenance.

According to a second aspect of the invention, there is provided a maintenance method configured to be applied to a liquid ejecting apparatus including a movable member provided so as to be movable with respect to the liquid ejecting apparatus configured to eject liquid from an ejection nozzle provided on an ejection head and configured to move when the liquid ejecting apparatus is inclined from a posture taken when ejecting the liquid by an action of the gravitational force, and a maintenance memory unit including a plurality of maintenance operations stored therein as maintenance operations to be performed on the ejection head, and configured to execute the maintenance operations for the ejection head including: storing the direction of movement of the movable member in response to abutment with the moved movable member; determining the direction of movement of the moved movable member by acquiring the contents stored by the storing after the power of the liquid ejecting apparatus has been turned ON; reading out a maintenance operation corresponding to the direction of movement of the moved movable member from a plurality of the maintenance operations stored in the maintenance memory unit; and executing the maintenance operation read out by the reading out for the ejection head.

In the maintenance method of the invention as described above, when the movable member is moved by the inclination of the liquid ejecting apparatus from the posture taken when ejecting liquid by the gravitational force, the direction of movement of the movable member caused in response to abutment with the movable member is stored. The contents stored in this manner are acquired after the power of the liquid ejecting apparatus has been turned ON to determine the direction of movement of the movable member, and the maintenance operation corresponding to the direction of movement is read out from the maintenance memory unit and is executed.

In this configuration, an adequate maintenance depending on the extent of change in the state of the ejection head is achieved even when the posture of the liquid ejecting apparatus is inclined when the power is OFF. Since the maintenance operation is performed automatically after the power has been turned ON, the maintenance operation can be executed reliably on the ejection head having a need for the maintenance.

BRIEF DESCRIPTION OF THE DRAWINGS

The invention will be described with reference to the accompanying drawings, wherein like numbers reference like elements.

FIG. 6 is an explanatory drawing showing a maintenance operation performed by the ink jet printer in the maintenance process to be performed when the power is turned ON.

DESCRIPTION OF EXEMPLARY EMBODIMENTS

In the following description, in order to clarify the contents of the invention according to the present application described above, an embodiment will be described in the following order.

A. Configuration of Device

Figure 1:
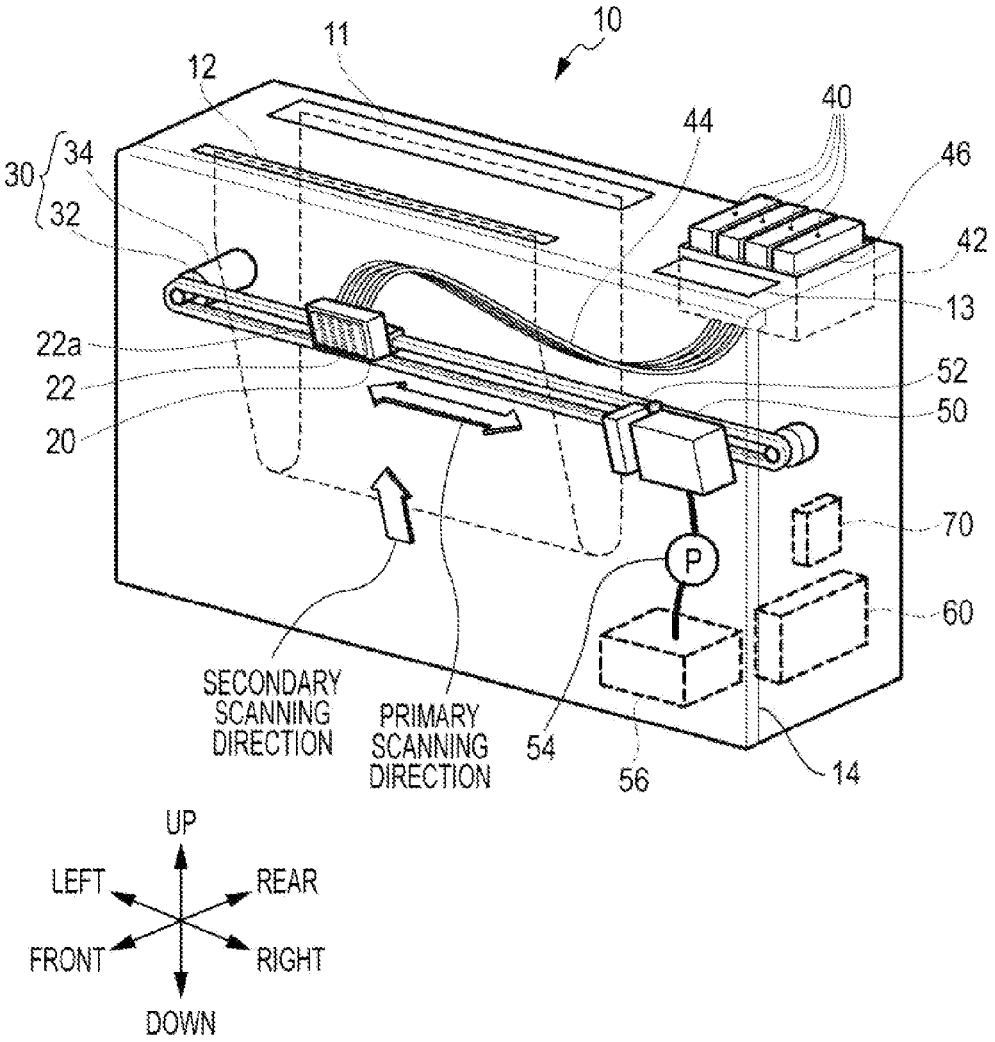
FIG. 1 is an explanatory drawing showing a rough configuration of a liquid ejecting apparatus according to an embodiment.

B. Falling Over Detection Mechanism of Ink Jet Printer according to an Embodiment C. Maintenance Process to be Performed when Power is Turned ON according to the Embodiment D. Modifications D-1. First Modification D-2. Second Modification D-3. Third Modification D-4. Fourth Modification A. Configuration of Device FIG. 1 is an explanatory drawing showing a rough configuration of a liquid ejecting apparatus according to an embodiment while using a so-called ink jet printer as an example. In the following description, "front and rear direction", "up and down direction", and "left and right direction" indicate "front and rear direction", "up and down direction", and "left and right direction" indicated by arrows in the drawings, respectively. An ink jet printer 10 shown in FIG. 1 has a substantially box-like shape in appearance, and includes a paper feeding port 11 into which printing sheets are set at the back side of an upper surface, and a paper discharging port 12 that discharges printed printing sheets at the front side of the upper surface. Although detailed description will be given later, in the ink jet printer 10 of the embodiment, when a printing sheet is set in the paper feeding port 11, the lower end of the set printing sheet is reversed so as to point upward by a paper feeding mechanism (not shown) in the interior of the ink jet printer 10, and then the printing sheet is transported upward inside the ink jet printer 10 and is discharged from the paper discharging port 12. In the drawing, a transportation route for the printing sheet in the ink jet printer 10 according to the embodiment is shown by a broken line. There is also provided a liquid crystal display unit 13 configured to display information relating to printing on the right side of the paper discharging port 12.

Provided on the front surface side of the ink jet printer 10 is a front surface cover 14. The front surface cover 14 is hinged at the lower end side of the front surface cover 14 and, when the upper end side falls toward the front, access to the interior of the ink jet printer 10 for confirmation of the state thereof or to service the ink jet printer 10 is provided.

Also, mounted in the interior of the ink jet printer 10 are a carriage 20 configured to form ink dots on the printing sheet while reciprocating in the primary scanning direction and a driving mechanism 30 configured to cause the carriage 20 to reciprocate. Provided on the front side of the carriage 20 (the side facing the front surface of the ink jet printer 10) is an ejection head 22 having a plurality of ejection nozzles. The surface of the ejection head 22 having the ejection nozzles (nozzle surface 22*a*) faces a paper surface of a printing sheet transported thereto and ink is ejected from the ejection nozzles toward the printing sheet.

The ink ejected from the ejection nozzles is stored in specific containers referred to as ink cartridges 40. The ink cartridges 40 are mounted in a cartridge holder 42 provided at a position different from the ejection head 22 (in the embodiment, an obliquely upper right portion of the ink jet printer 10) and ink in the ink cartridges 40 is supplied to the carriage 20 via ink tubes 44. A cartridge replacement slot 46 is provided in the upper surface of the ink jet printer 10. By inserting the ink cartridges 40 into the cartridge replacement slot 46, the ink cartridges 40 can be mounted in the cartridge holder 42, and by pulling out the ink cartridges 40 from this state, the ink cartridges 40 can be removed.

The ink jet printer 10 shown in FIG. 1 is capable of printing a color image using four types of ink, namely, cyan, magenta, yellow, and black, and the ejection head 22 is formed with ejection nozzles for each type of ink. Each of the ejection nozzles receives supply of ink from the corresponding ink cartridge 40 via the ink tube 44 provided for each type of ink.

The driving mechanism 30 which causes the carriage 20 to reciprocate includes a timing belt 32 formed with a plurality of teeth on the inner side thereof, and a driving motor 34 configured to drive the timing belt 32. Part of the timing belt 32 is fixed to the carriage 20. When the timing belt 32 is driven, the timing belt 32 causes the carriage 20 to reciprocate in the primary scanning direction while the carriage 20 is guided by a guide rail, not shown, extending in the primary scanning direction.

There is provided an area referred to as a "home position" at a position outside of a printing area where the carriage 20 is moved in the primary scanning direction, and a maintenance mechanism is mounted at the home position. The maintenance mechanism includes a cap 50, a wiper 52, a negative pressure pump 54, and a waste ink tank 56, and the maintenance mechanism performs various maintenance operations to maintain the state of the ejection head 22 normal. First of all, the cap 50 is capable being moved in the fore-and-aft direction of the ink jet printer 10 by a driving mechanism, not shown. Then, when printing is not being performed, the cap 50 is pressed against the front side of the carriage 20 to form a closed space so as to cover the ejection head 22 in a state in which the carriage 20 is moved to its home position, thereby preventing the ink in the ejection head 22 from drying.

The negative pressure pump 54 is connected to the cap 50 via a negative pressure tube. By activating the negative pressure pump 54 in a state in which the cap 50 is pressed against the front side of the carriage 20, an operation to suck the ink into the ejection head 22 and discharge the sucked ink into the waste ink tank 56 (cleaning operation) may be performed. In addition, by activating the negative pressure pump 54 in a state in which the cap 50 and the ejection head 22 face each other, an operation (flushing operation) to cause the ejection head 22 to eject and discharge the ink to the cap 50 may also be performed. When the normal ejection of the ink from the ejection head 22 cannot be performed due to a breakage of meniscuses in the ejection nozzles, the cleaning operation or the flushing operation described above is performed so that the state of the ejection head 22 is maintained in a normal condition.

In addition, the wiper 52 is movable in the fore-and-aft direction using the driving mechanism, not shown, and an operation to wipe off ink adhered to the nozzle surface (wiping operation) is performed by bringing a distal end portion of the wiper 52 into abutment with the front surface (the nozzle surface 22*a*) of the ejection head 22 provided with a plurality of ejection nozzles and, in this state, moving the carriage 20 in the primary scanning direction.

In the interior of the ink jet printer 10, the paper feeding mechanism, not shown, for feeding printing sheets and a control unit 60 configured to control the operation of the entire ink jet printer 10 are mounted. The operation for causing the carriage 20 to reciprocate, the operation for feeding the printing sheet, the operation for ejecting ink from the ejection nozzle, the operation for executing the maintenance to achieve normal printing, and so on are all controlled by the control unit 60. In addition to the configuration described above, the ink jet printer 10 of the embodiment is provided with a falling over detection mechanism 70 configured to detect falling over of the ink jet printer 10. Detailed description of the falling over detection mechanism 70 will be given later.

Figure 2:
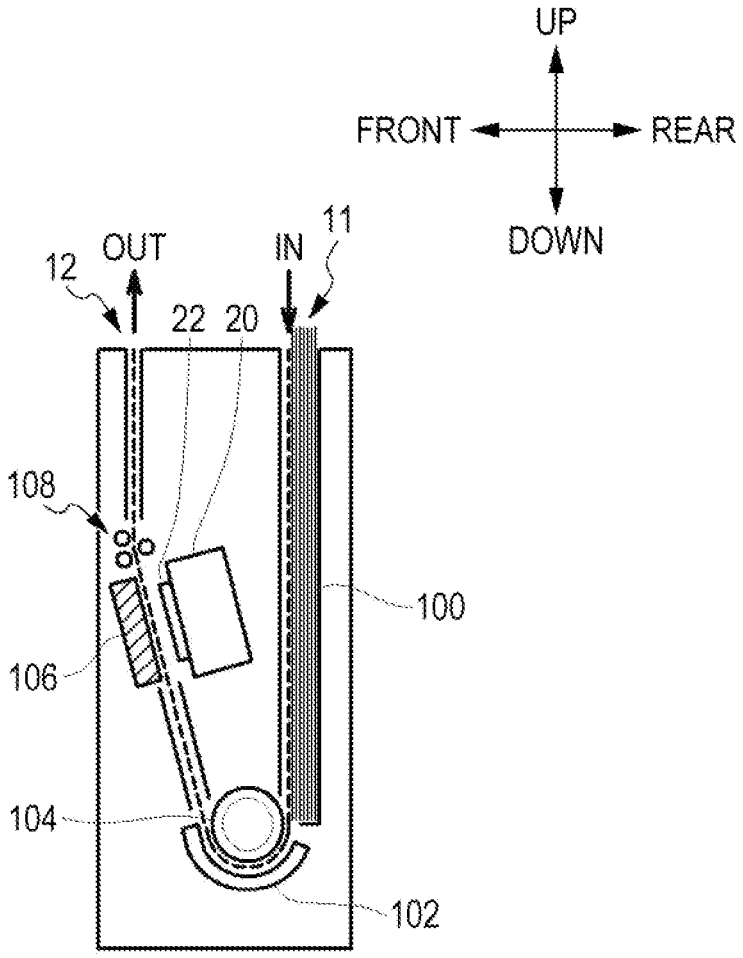
FIG. 2 is an explanatory drawing showing a printing operation of the liquid ejecting apparatus according to the embodiment.

FIG. 2 is an explanatory drawing showing a printing operation of the ink jet printer 10 of the embodiment. In FIG. 2, a printing area of the ink jet printer 10 viewed from the side of the ink jet printer 10 is shown. First of all, the printing sheets set in the paper feeding port 11 are received in a sheet receiving portion 100. The printing sheet received in the sheet receiving portion 100 are pressed toward the front of the ink jet printer 10 by a spring, not shown, and are pressed against a paper feed roller 104 provided in front of the sheet receiving portion 100. The paper feed roller 104 is an elongated column-shaped member and the side surface thereof, which corresponds to the circumferential portion, is formed of a rubber material. A paper feed motor, not shown, is connected to one end of the paper feed roller 104. When the paper feed roller 104 is rotated by the paper feed motor, the printing sheets are fed downward one by one from the sheet receiving portion 100.

Provided right below the paper feed roller 104 is a substantially U-shaped guide member 102. Therefore, a printing sheet fed downward by the paper feed roller 104 is transported along the guide member 102, so that the transporting direction of the printing sheet is inverted so as to point upward. Accordingly, the printing sheet is transported upward, and in mid-course, ink is ejected onto the printing sheet while the printing sheet is passed over a platen 106 provided at a position facing the nozzle surface 22*a* of the ejection head 22, whereby an image is printed. The printing sheet on which the image is printed in this manner is transported further upward by a paper feed roller 108 provided above the platen 106, and is discharged finally from the paper discharging port 12 in the upper surface of the ink jet printer 10.

Since the ink jet printer 10 of the embodiment as described above is adapted to eject ink onto the printing sheet while the printing sheet is transported in a substantially vertical direction, components of the ink jet printer 10 are arranged in the direction of height of the ink jet printer 10. Therefore, the surface area for installation of the ink jet printer 10 may be reduced in comparison with a type of printer which prints while transporting the printing sheet in a substantially horizontal direction like in general ink jet printers. In contrast, the ink jet printer 10 can easily fall over due to the reduced surface area for installation.

Figure 3A:
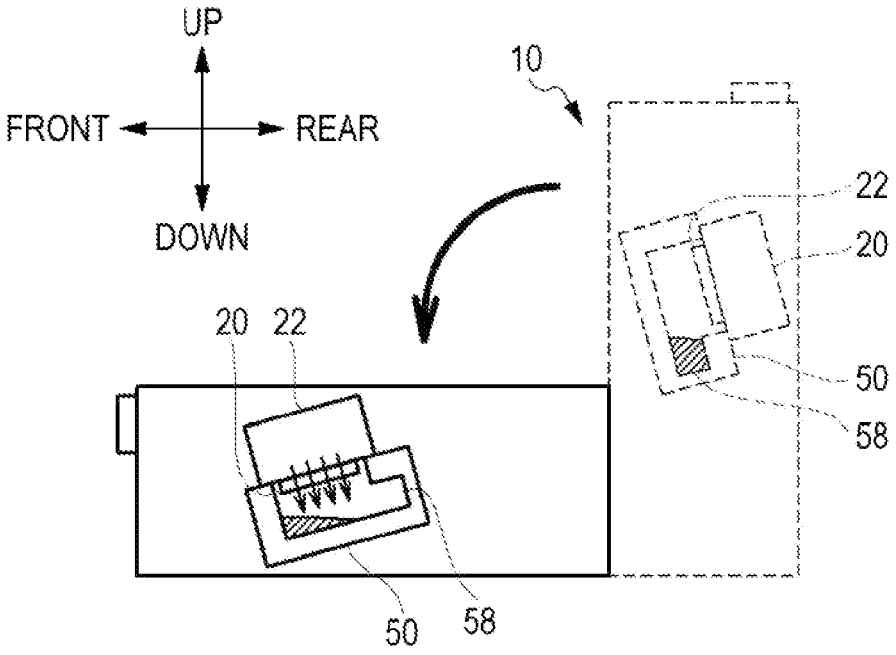
FIGS. 3A and 3B are explanatory drawings showing a state of the interior of an ink jet printer when the ink jet printer is fallen.
Figure 3B:
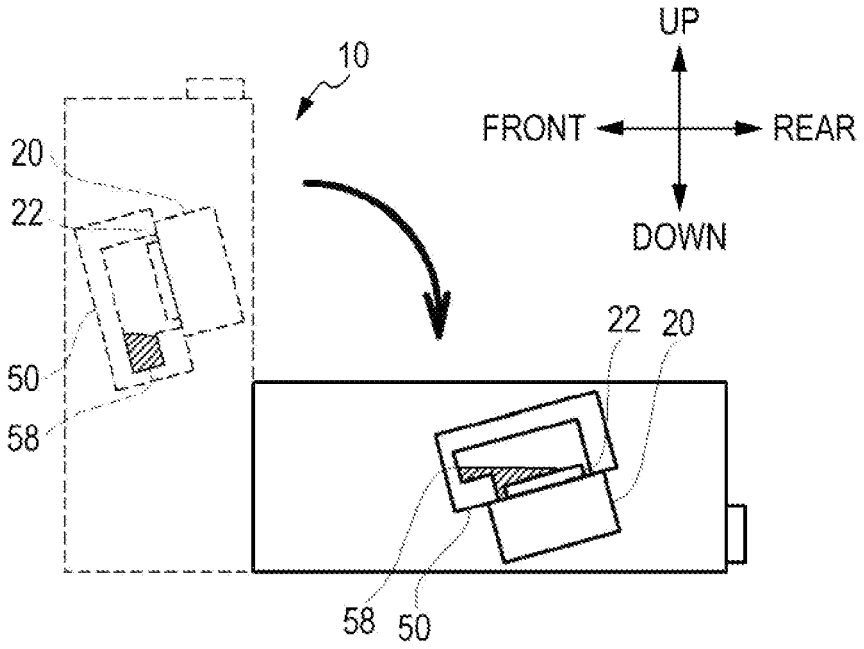

FIGS. 3A and 3B are explanatory drawings showing a state of the interior of the ink jet printer when the ink jet printer has fallen over. In FIGS. 3A and 3B, a case in which the ink jet printer 10 has fallen over during a standby period before starting printing is shown as an example. The standby period here denotes a period when supply of electric power to the ink jet printer 10 is shut down, or a period when printing is not performed although electric power is supplied to the ink jet printer 10.

As shown in FIG. 3A and FIG. 3B, during the standby period of the ink jet printer 10, the periphery of the ejection head 22 is sealed by the cap 50. Provided in the interior of the cap 50 is a storage groove 58 configured to accumulate ink ejected into the cap 50 by the flushing operation, whereby the humidity in the space sealed by the cap 50 is maintained. Therefore, deterioration of properties due to drying of ink in the ejection head 22 is effectively restrained. When the ink jet printer 10 falls over toward the front from this state as shown in FIG. 3A, the ink in the ejection head 22 comes out from the ejection nozzles downward (the direction toward the cap 50) due to the momentum of falling over, so that the meniscuses in the ejection nozzles are broken. As shown in FIG. 3B, when the ink jet printer 10 falls over backward, the nozzle surface 22*a* is contaminated by the ink from the storage groove 58 of the cap 50.

In this manner, when the ink jet printer 10 falls over, an adverse effect is exerted on the ejection head 22. In other words, when the ink jet printer 10 falls over toward the front (the case shown in FIG. 3A), the meniscuses in the ejection nozzles are broken, or air bubbles may enter from the ejection nozzles. When the ink jet printer 10 falls over toward the rear (the case shown in FIG. 3B), the ink from the storage groove 58 may enter the ejection nozzles and hence color mixture of ink may be resulted, or defective discharge due to solidification of ink adhered to the nozzle surface 22*a* may occur. Therefore, the ink cannot be ejected normally when the printing is started in this state, which may result in adverse effect on a printed result. Therefore, it is necessary to maintain the ejection head 22 in a normal state by detecting the presence or absence of falling over of the ink jet printer 10 and, if present, performing a required maintenance operation.

Here, as a method of detecting the presence or absence of falling over of the ink jet printer 10, for example, a method using an acceleration sensor is contemplated. However, when the acceleration sensor is used, the falling over of the ink jet printer 10 cannot be detected when the power of the ink jet printer 10 is OFF. Therefore, even when the falling results in adverse effect on the ejection head 22, the maintenance operation cannot be performed and, consequently, the ink cannot be ejected normally from the ejection head 22. Therefore, in the ink jet printer 10 of the embodiment, occurrence of the problem described above is prevented by employing the falling over detection mechanism of the ink jet printer 10 as described below.

Figure 4A:
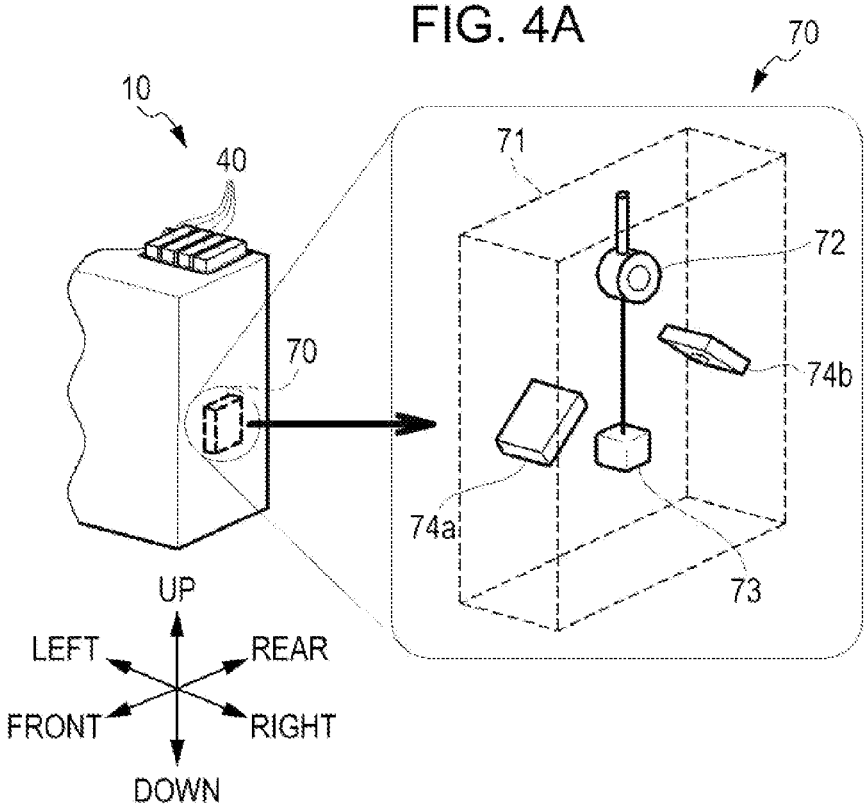
FIGS. 4A and 4B are explanatory drawings showing a state in which a falling over detection mechanism of the ink jet printer according to the embodiment.
Figure 4B:
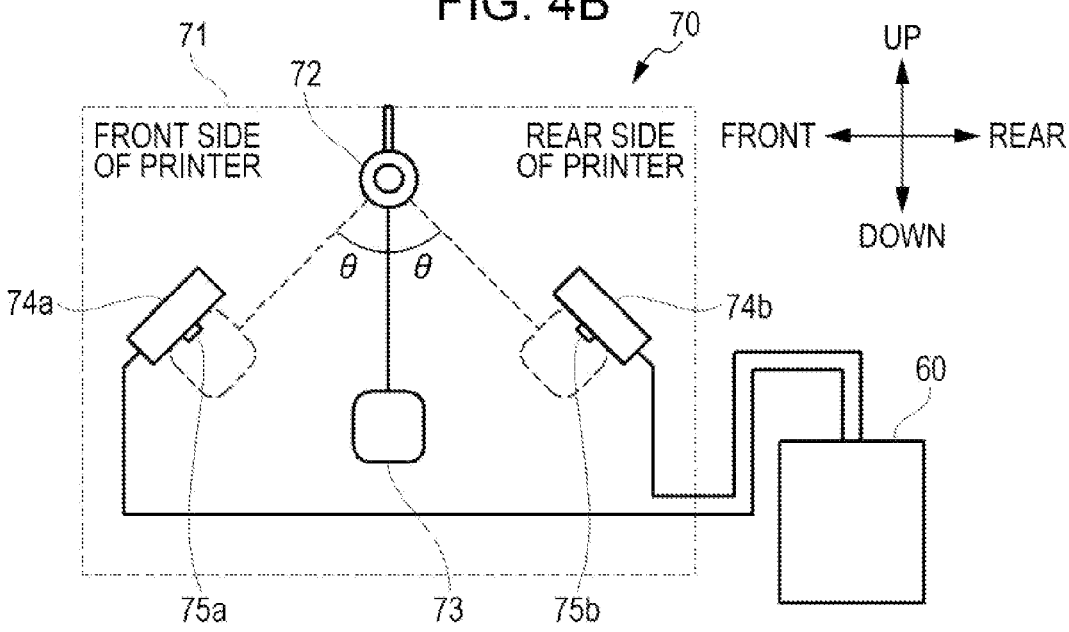

B. Falling Over Detection Mechanism of Ink Jet Printer According to the Embodiment FIGS. 4A and 4B are explanatory drawings showing a state in which the falling over detection mechanism 70 of the ink jet printer 10 according to the embodiment. As shown in FIG. 4A, the falling over detection mechanism 70 of the embodiment includes a storage box 71 configured to accommodate components of the falling over detection mechanism 70, a weight 73 as a movable member configured to be suspended from a supporting member 72 provided on a sealing of the storage box 71, and switch mechanisms 74*a* and 74*b* as a memory unit provided on the left and the right of the weight 73 in side view of the ink jet printer 10.

As shown in FIG. 4B, the weight 73 comes into contact with a switch 75*a* provided on the switch mechanism 74*a* at a point swung by an angle of θ toward the front of the ink jet printer 10 about the supporting member 72 as a supporting point, and comes into contact with a switch 75*b* on the switch mechanism 74*b* at a point swung by an angle θ toward the rear of the ink jet printer 10. When the weight 73 comes into contact with the switch 75, the switch 75 is pushed inside the switch mechanism 74, and is held in the interior of the switch mechanism 74 by a locking mechanism, not shown. Which one of the switches 75*a* and 75*b* is held in the switch mechanism 74 can be detected by the control unit 60. The switch 75 held in the switch mechanism 74 can be restored to its former state (the state projecting from the switch mechanism 74) by unlocking the locking mechanism (not shown).

In the falling over detection mechanism 70 of the embodiment configured as described above, when the ink jet printer 10 falls over when the power is OFF, the weight 73 moves in the direction of gravitational force, and the switch 75 on the side of falling over of the ink jet printer 10 is pushed into the switch mechanism 74 and held in the state of being pushed in. Therefore, even under the state in which the power supply is shut down like when the power is OFF, the fact that the ink jet printer 10 has fallen can be stored. It is also possible to store the direction of falling over of the ink jet printer 10 depending on which one of the switches 75*a* and 75*b* is pushed. Therefore, in the ink jet printer 10 of the embodiment, the following maintenance process as described below is performed on the basis of the content which is stored in the falling over detection mechanism 70.

Figure 5:
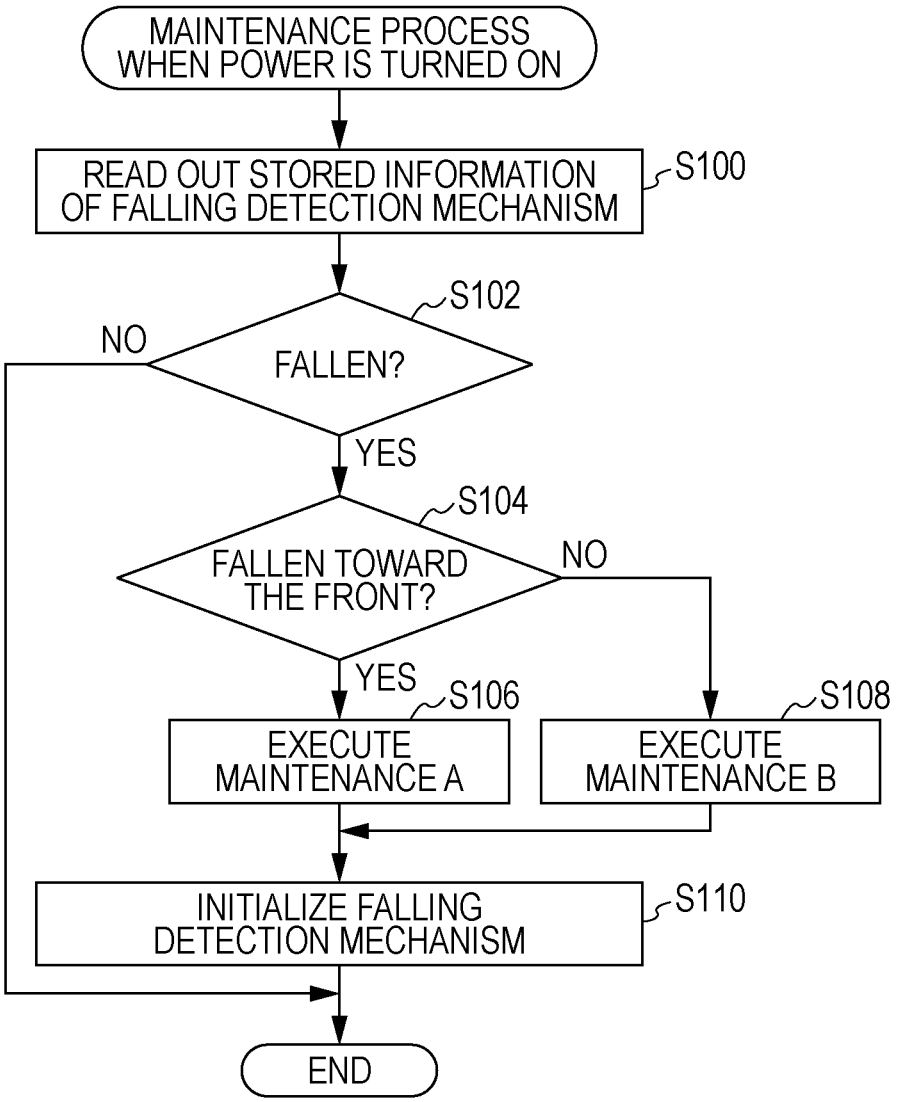
FIG. 5 is a flowchart showing a maintenance process to be performed when the power is turned ON according to the embodiment.

C. Maintenance Process to be Performed when Power is Turned ON According to the Embodiment FIG. 5 is a flowchart showing a maintenance process to be performed when the power is turned ON according to the embodiment. The maintenance process when the power is turned ON is a process performed by the control unit 60 when the power of the ink jet printer 10 is turned ON.

When the maintenance process to be performed when the power is turned ON is started, information on the falling over of the ink jet printer 10 stored in the falling over detection mechanism 70 is read out (Step S100) as a first step. As described in conjunction with FIGS. 4A and 4B, if the ink jet printer 10 has fallen during the period when the power was OFF, it might be expected that the switch 75 has pressed by the weight 73 and hence is held in the interior of the switch mechanism 74 (the state in which the switch 75 is ON). In contrast, if the ink jet printer 10 has not fallen, it might be expected that both of the switches 75*a* and 75*b* are in the OFF state. Therefore, in Step S100 of the maintenance process to be performed when the power is turned ON, whether or not the ink jet printer 10 has fallen during the period when the power was OFF is determined by detecting the ON/OFF state of the switches 75*a* and 75*b* (Step S100).

Then, when both of the switches 75*a* and 75*b* are detected to be OFF in Step S100, it is determined that the ink jet printer 10 has not fallen during the period when the power was OFF (no in Step S102), so that the maintenance process to be performed when the power is turned ON is ended without performing the maintenance process for the ejection head 22.

In contrast, if the ink jet printer 10 is determined to have fallen during the period when the power is OFF by having detected that at least one of the switches 75*a* and 75*b* is ON (yes in Step S102), whether or not the ink jet printer 10 has fallen only toward the front (Step S104). When the ink jet printer 10 is determined to have fallen only toward the front due to the detection of the fact that the switch 75*a* is ON and the switch 75*b* is OFF (yes in Step S104), a maintenance process A is performed for the ejection head 22 (Step S106). If it is determined that the falling toward the rear has occurred by being detected that at least the switch 75*b* is ON (no in Step S104), a maintenance process B is performed (Step S108).

FIG. 6 is an explanatory drawing showing a maintenance operation performed by the ink jet printer 10 in the maintenance process to be performed when the power is turned ON. As described above, when the ink jet printer 10 falls over toward the front when the power is OFF, ink comes out from the ejection nozzles and hence the meniscuses in the ejection nozzles are broken (see FIG. 3A), and what is necessary is just to perform a maintenance operation for setting the broken meniscus. In contrast, when the ink jet printer 10 falls over toward the rear, not only the meniscus is broken by the momentum of the falling, but also the nozzle surface 22*a* is contaminated by ink from the cap 50 (see FIG. 3B). In this case, in addition to the maintenance operation described above, a maintenance operation to wipe off the contaminated nozzle surface 22*a* is needed.

Therefore, in the maintenance process to be performed when the power is turned ON in the embodiment, when the ink jet printer 10 has fallen only toward the front, the flushing operation is performed as the maintenance operation for settling the meniscus of the ejection nozzles, and then a cleaning operation (weak suction) for sucking a small amount of ink is performed, and a wiping operation is performed last as shown in FIG. 6 (Step S106). When it is determined that the ink jet printer 10 has fallen at least toward the rear, the nozzle surface 22*a* contaminated with ink is wiped off as a first step, then a cleaning operation (strong suction) for sucking a relatively large amount of ink is performed to suck out ink entered into the ejection nozzles, and then the above-described light maintenance process for settling the meniscuses in the ejection nozzle is performed (Step S108).

As described above, the control unit 60 of the embodiment acquires the contents stored in the switch mechanism 74 (memory unit) after the power of the ink jet printer 10 has been turned ON and determines whether or not the weight 73 (movable member) is moved and, if it is determined that the weight 73 is moved, executes the maintenance operation with respect to the ejection head 22. The control unit 60 stores a plurality of maintenance operations in order to execute the maintenance operation in accordance with the direction of movement of the weight 73 (movable member). Therefore, the control unit 60 corresponds to a determining unit, a maintenance unit, and a maintenance memory unit in the invention.

The adverse effects (abnormal meniscuses in the ejection nozzles, entry of air bubbles into the ejection nozzles, mixture of ink into the ejection nozzles, or defective discharge of ink due to the solidification of the ink on the nozzle surface 22*a*, etc.) occurred on the ejection head 22 are eliminated by performing the maintenance operations (Step S106, Step S108), then the falling over detection mechanism 70 is initialized by releasing the lock in the interior of the switch mechanism (Step S110), and the maintenance process to be performed when the power is turned ON is ended.

According to the maintenance process to be performed when the power is turned ON in the embodiment as described thus far, falling over of the ink jet printer 10 can be detected after the fact by reading out the information (presence or absence of falling, direction of falling) relating to the falling over of the ink jet printer 10 during the period when the power is OFF, which has been stored using the falling over detection mechanism 70. Therefore, since there is no possibility to fail to detect falling over of the ink jet printer 10 occurred during the period when the power is OFF, the maintenance operation required of the ejection head 22 can be performed before printing and, consequently, occurrence of the adverse effects on the printing can be avoided.

Also, it is normal that the period when the power of the ink jet printer 10 is OFF is longer than the period when the power of the ink jet printer 10 is ON. Therefore, the frequency when the falling over of the ink jet printer 10 occurs is considered to be higher in the period when the power of the ink jet printer 10 is OFF. In this manner, falling occurred during the period when likelihood that falling occurs is high can be detected.

When executing the maintenance operation, the method of maintenance may be changed on the basis of the direction of falling over of the ink jet printer 10. Accordingly, when the maintenance should be performed sufficiently (when fallen toward the rear in the embodiment), the required maintenance operations may be performed and, when the sufficient maintenance is not so much needed (when fallen toward the front in the embodiment), needless maintenance operations can be omitted. Consequently, the time period required for the maintenance of the ejection head 22 can be reduced, and the amount of ink discarded by the maintenance can be reduced.

D. Modifications

There are several conceivable modifications of the embodiment described above. These modifications are described briefly below. In the modifications shown below, like numbers reference elements similar to those of the embodiment described above, and detailed description thereof is omitted.

D-1. First Modification

In the embodiment described above, the switches 75*a* and 75*b* of the falling over detection mechanism 70 have been described to be maintained in the ON state by the locking mechanism in the switch mechanism 74. However, the switches 75*a* and 75*b* may be maintained in the ON state in the following manner.

Figure 7:
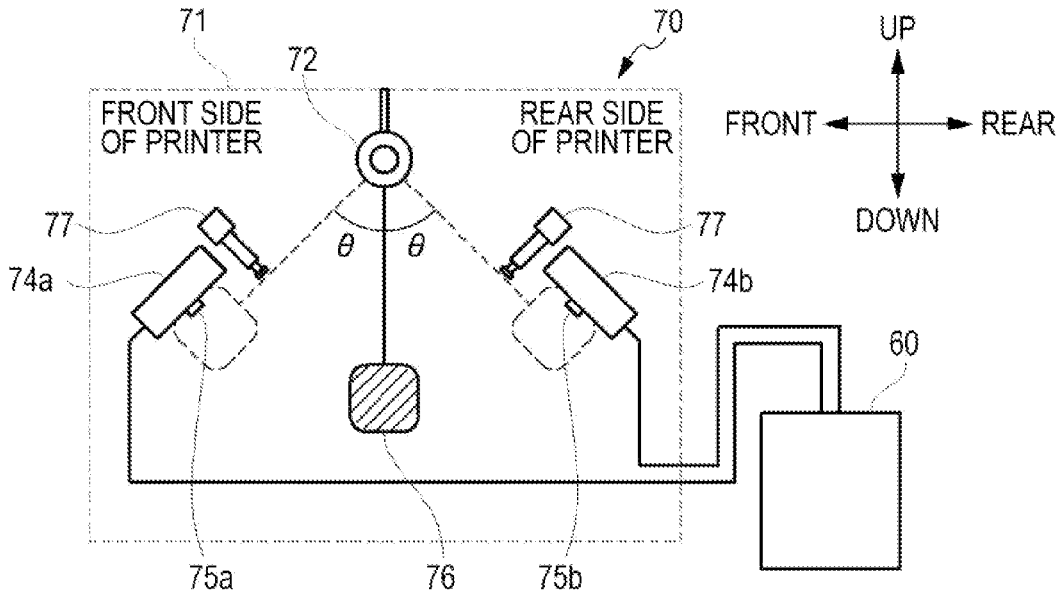
FIG. 7 is an explanatory drawing showing the falling over detection mechanism according to a first modification.

FIG. 7 is an explanatory drawing showing the falling over detection mechanism 70 according to a first modification. In the falling over detection mechanism 70 shown in the embodiment, a magnet 76 is used instead of the weight 73 with respect to the falling over detection mechanism 70 shown in FIGS. 4A and 4B. Surfaces of the switch mechanisms 74*a* and 74*b* coming into abutment with the magnet 76 are formed of a metal, and the switches 75*a* and 75*b* are kept in the state of being pushed (the ON state) by attraction between the magnet 76 and the surfaces of the switch mechanisms 74*a* and 74*b*. Provided respectively above the switch mechanisms 74*a* and 74*b* are separating mechanisms 77 for separating the magnet 76 adhered to the switch mechanisms 74*a* and 74*b* from the switch mechanisms 74*a* and 74*b*.

Even when the falling over detection mechanism 70 according to the first modification as described above is used, the direction of falling over of the ink jet printer 10 during a period when the power is OFF can be stored. In addition, since the locking mechanism for holding the switch 75 in the interior does not have to be provided in the switch mechanism 74, the switching mechanism 74 can be simplified.

D-2. Second Modification

In the embodiment described above, the weight 73 of the falling over detection mechanism 70 has been described to be held movably by being suspended from the supporting member 72. However, the weight 73 may be configured to be movable by the configuration described below.

Figure 8:
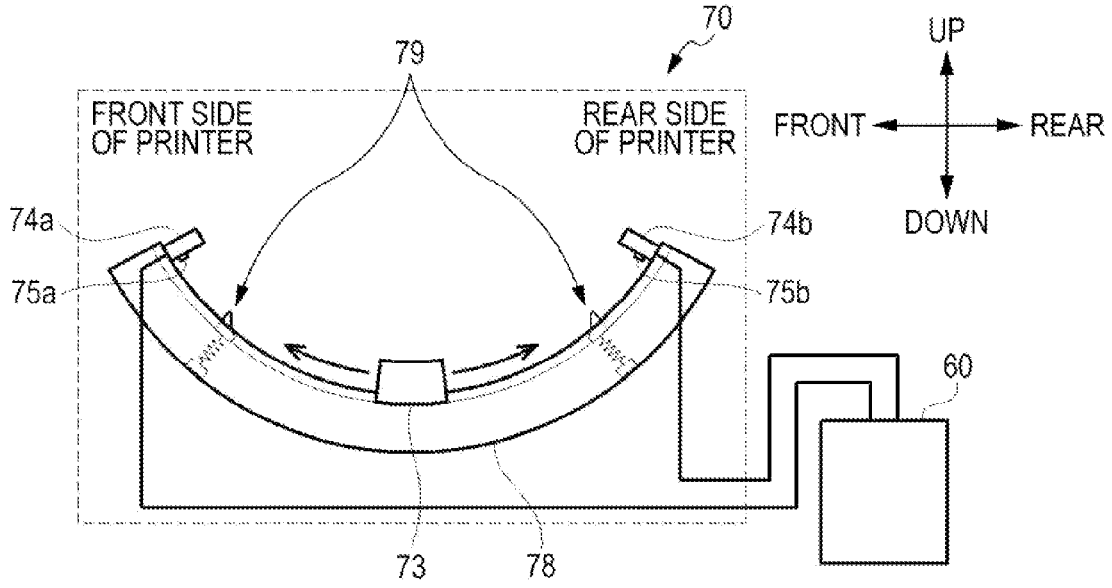
FIG. 8 is an explanatory drawing showing the falling over detection mechanism according to a second modification.

FIG. 8 is an explanatory drawing showing the falling over detection mechanism 70 according to a second modification. The falling over detection mechanism 70 shown in FIG. 8 is provided with a slide rail 78 having a substantially arcuate shape between the switch mechanism 74*a* and the switch mechanism 74*b*, and the weight 73 is configured to be slidable between the switch mechanism 74*a* and the switch mechanism 74*b* along the slide rail 78 by fitting the weight 73 partly into the groove provided on the slide rail 78. Provided on the slide rail 78 at the midpoints of the routes where the weight 73 moves toward the respective switches 75*a* and 75*b* are holding claws 79. The holding claws 79 are held in a state in which distal ends of the holding claws 79 project slightly from the slide rail 78 by spring mechanisms integrated into the slide rail 78. Provided in the interior of the slide rail 78 are accommodating mechanisms (not shown) configured to accommodate the holding claws 79 in the slide rail 78 against the spring force.

In the falling over detection mechanism 70 in the second modification as described above, when the ink jet printer 10 falls over toward the front, the weight 73 climbs over the holding claws 79 and the weight 73 is fixed by the holding claw 79 at a position climbed over (the position which allows the weight 73 to come into contact with the switch 75*a*). When the ink jet printer 10 falls over toward the rear, the weight 73 climbs over the holding claw 79, and is fixed to a position which allows contact with the switch 75*b*. Also, by accommodating the holding claw 79 in the slide rail 78 in a state in which the weight 73 is held by the holding claw 79, the weight 73 can be returned to its original position (the position shown in FIG. 8). Therefore, in the same manner as the falling over detection mechanism 70 of the embodiment described above, the direction of falling over of the ink jet printer 10 in the case where the ink jet printer 10 falls over during the period when the power is OFF can be stored. Since the weight 73 is guided by the slide rail 78, the weight 73 can be guided to a position of the switch 75.

D-3. Third Modification

In the embodiment, the first modification, and the second modification described above, the falling over detection mechanism 70 has been described to be configured using a pendulum or the slide rail 78. As a configuration of the falling over detection mechanism 70 here, a configuration as shown below is also conceivable in addition to those described above.

Figure 9A:
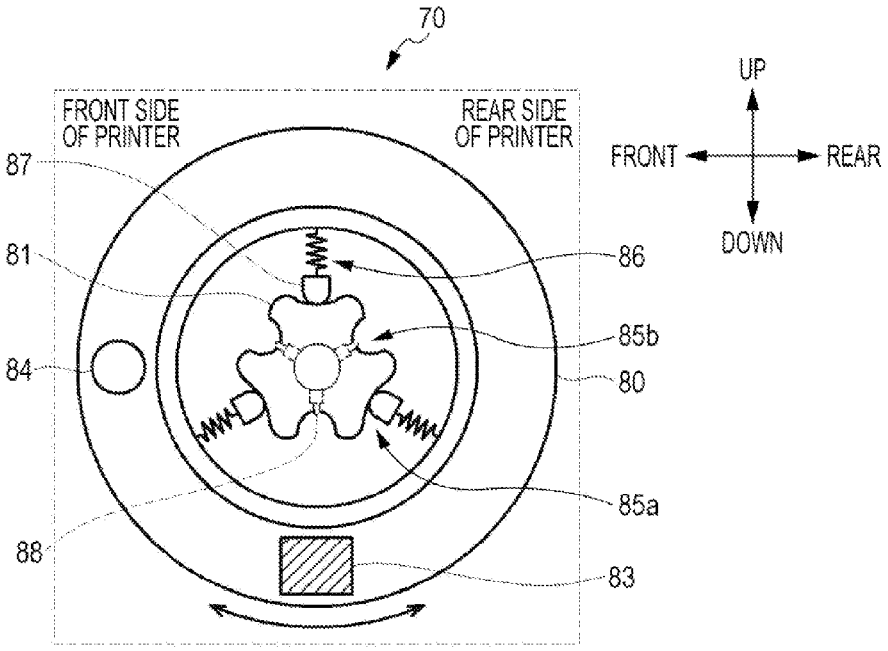
FIGS. 9A to 9C are explanatory drawings showing the falling over detection mechanism according to a third modification.
Figure 9B:
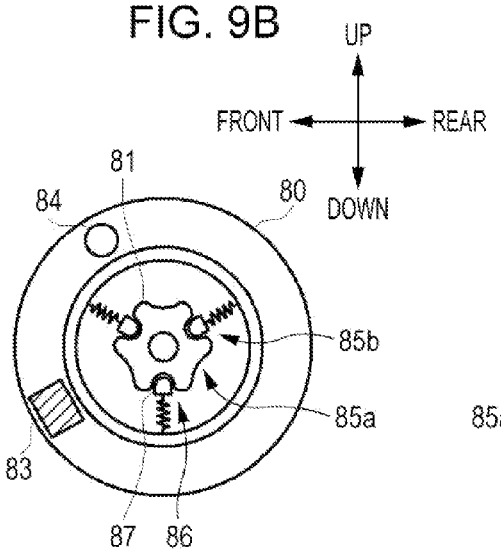
Figure 9C:
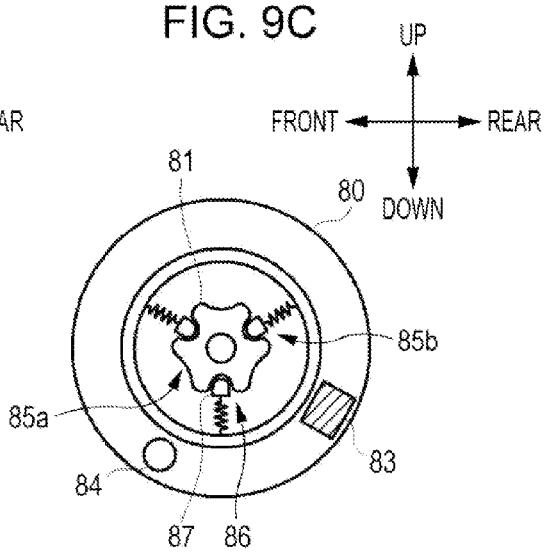

FIGS. 9A to 9C are explanatory drawings showing the falling over detection mechanism 70 according to a third modification. The falling over detection mechanism 70 shown in FIGS. 9A to 9C includes a disk member 80 having a center portion removed in a circular shape, a shaft portion 81 passing through the center of the disk member 80, and a mechanism for holding the disk member 80 on the shaft portion 81. Provided at one position on the surface of the disk member 80 is a weight 83, and provided at a position on the surface of the disk member 80 different from the weight 83 is a through hole 84. On an outer peripheral surface of the shaft portion 81, shallow fixing grooves 85*a* are provided at three points equidistantly along the outer periphery, and deep fixing grooves 85*b* deeper than the fixing grooves 85*a* are provided between the fixing groove 85*a* and the fixing groove 85*a*, respectively. In a state in which the ink jet printer 10 is held in the posture taken when ejecting ink (posture in the normal state), distal end portions (projecting portions 87) of urging members 86 provided at three points on an inner peripheral surface of the disk member 80 are pushed against the shallow fixing grooves 85*a* respectively, and the disk member 80 is held on the shaft portion 81 as shown in FIG. 9A. Provided in the vicinity of bottoms of the deep fixing grooves 85*b* are releasing mechanisms 88 configured to push the projecting portions 87 upward and release the fitting when the projecting portions 87 are fitted into the fixing grooves 85*b* as described later.

In the falling over detection mechanism 70 according to the third modification configured as described thus far, when the ink jet printer 10 falls over toward the front, the disk member 80 rotates clockwise about the shaft portion 81 due to the weight of the weight 83. At this time, the projecting portions 87 of the urging members 86 are slid toward the deep fixing grooves 85*b* adjacent in the clockwise direction with respect to the shallow fixing grooves 85*a* and are fitted to the deep fixing grooves 85*b* finally as shown in FIG. 9B. In this state, the disk member 80 is fixed to the shaft portion 81 and is not capable of rotating. Therefore, even when the ink jet printer 10 is reinstalled on the ground and the direction of the gravitational force exerted on the weight 83 changes, the disk member 80 never returns to its original position (the position shown in FIG. 9A). Consequently, the state in which the disk member 80 is rotated to some degree clockwise (the state shown in FIG. 9B) is maintained until the power of the ink jet printer 10 is turned ON.

When the ink jet printer 10 falls over toward the rear, the disk member 80 rotates counterclockwise about the shaft portion 81 due to the weight of the weight 83. Consequently, as shown in FIG. 9C, the projecting portions 87 of the urging members 86 fit into the deep fixing grooves 85*b* adjacent to the shallow fixing groove 85*a* in the counterclockwise direction, and this state is maintained until the power of the ink jet printer 10 is turned ON.

With the falling over detection mechanism 70 according to the third modification as described above, the position of the disk member 80 rotated by the weight of the weight 83 can be maintained when fallen when the power is OFF. Therefore, for example, by detecting the position of the through hole 84 on the disk member 80 using a sensor such as a photo interrupter in a state in which the power of the ink jet printer 10 is turned ON, the direction of falling over of the ink jet printer 10 when the power is OFF can be detected. Also, by causing the projecting portions 87 to fit into the deep fixing grooves 85*b*, the state of the disk member 80 after the rotation can reliably be maintained.

D-4. Fourth Modification

In the embodiment, the first modification, the second modification, and the third modification described above, the presence or absence of falling over of the ink jet printer 10 during the period when the power is OFF and the direction of falling are described to be stored using the falling over detection mechanism 70. By using the falling over detection mechanism 70 described below, the inclination of the ink jet printer 10 during the period when the power is OFF can also be stored.

Figure 10:
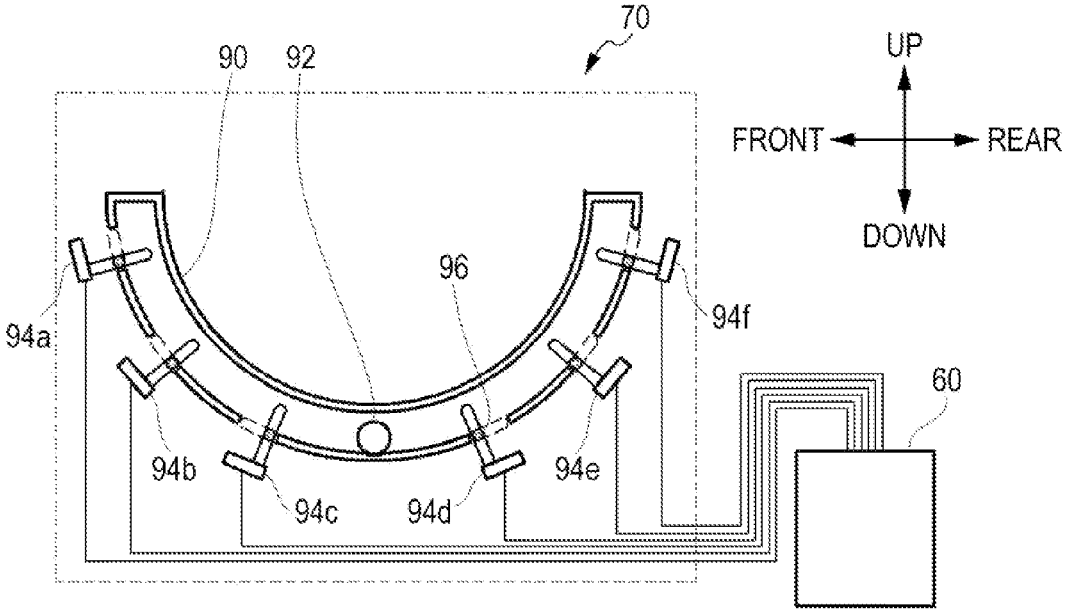
FIG. 10 is an explanatory drawing showing the falling over detection mechanism according to a fourth modification.

FIG. 10 is an explanatory drawing showing the falling over detection mechanism 70 according to a fourth modification. The falling over detection mechanism 70 shown in FIG. 10 is provided with a substantially arcuate shaped guide passage 90 closed at both ends, and a ball 92 which is movable by rolling in the guide passage 90 is provided in the guide passage 90. Provided at the midsection of the guide passage 90 are six pins 94 (pins 94*a* to 94*f*) substantially equidistantly along a wall surface of the guide passage 90. A hinge 96 is provided at a position where each of the pins 94 intersects the wall surface of the guide passage 90, so that when the ball 92 moving along the guide passage 90 comes into contact with the pin 94, the pin 94 falls over in the direction of travel of the ball 92 from the position of the hinge 96. The fallen pin 94 is restored to the state before falling by a restoring mechanism, not shown, and, in addition, which pin or pins 94 has or have bent can be detected by the control unit 60.

In the falling over detection mechanism 70 according to the fourth modification as described above, when the ink jet printer 10 is inclined little toward the front from the state of being installed on the surface for installation, the ball 92 moves little toward the front of the ink jet printer 10 along the guide passage 90 by the gravitational force and, at this time, the pin 94*c* is fallen down by the ball 92. When the ink jet printer 10 is inclined further toward the front from this state, the ball 92 moves further toward the front and the pin 94*b* is fallen down. When the ink jet printer 10 is finally fallen toward the front, the pin 94*a* is fallen down by the ball 92. When the ink jet printer 10 is inclined little toward the rear, the ball 92 moves little toward the rear and the pin 94*d* is fallen down. When the ink jet printer 10 is inclined further toward the rear, the pin 94*e* is fallen down by the ball 92. When the ink jet printer 10 is finally fallen toward the rear, the pin 94*f* is fallen down.

In the falling over detection mechanism 70 according to the fourth modification as described above, the extent of inclination of the ink jet printer 10 can be stored on the basis of how the pins 94 are fallen down. In this configuration, a case where the ink jet printer 10 is fallen down during the period when the power is OFF and a case where the ink jet printer 10 is not fallen down but inclined to some extent from the original angle of installation can be stored distinctly. In this configuration, when executing the maintenance process to be performed when the power is turned ON as described above (see FIG. 6) in a state in which the power of the ink jet printer 10 is ON, the content of the maintenance can be changed depending on the inclination of the ink jet printer 10.

Although the various embodiments have been descried, the invention is not limited to all of the embodiments described above, and various modes may be employed without departing the scope of the invention. For example, in the embodiment and the modifications described above, the ink jet printer has been described to be applied to the invention as an ink jet printer which performs printing while transporting the printing sheets in the substantially vertical direction (so called a vertical type ink jet printer). However, the invention may be applied to ink jet printers configured to print while transporting the printing sheet in the substantially horizontal direction.

What is claimed is:

1. A liquid ejecting apparatus configured to eject ink from an ejection nozzle comprising:

a movable member provided so as to be movable with respect to the liquid ejecting apparatus and configured to move when the liquid ejecting apparatus is inclined by an action of the gravitational force from a posture taken when ejecting the liquid; and a determining unit configured to determine the direction of movement of the moveable member;

a maintenance unit configured to execute a maintenance operation on an ejection head;

a maintenance memory unit configured to store a plurality of maintenance operations in one-to-one correspondence with the directions of movement of the movable member as maintenance operations to be performed on the ejection head; and the maintenance unit reads out the maintenance operation corresponding to the direction of movement of the moved movable member from among a plurality of the maintenance operations when the direction of movement is determined by the determining unit, and executes the read-out maintenance operation.

2. The liquid ejecting apparatus according to claim 1 further comprising:

a memory unit configured to store the direction of movement of the movable member in response to abutment with the moved movable member, and wherein the determining unit is a unit configured to determine the direction of movement of the moved movable member by acquiring the stored contents of the memory unit.

3. A maintenance method configured to be applied to a liquid ejecting apparatus including a movable member that is provided so as to be movable with respect to the liquid ejecting apparatus configured to eject liquid from an ejection nozzle provided on an ejection head and that is configured to move when the liquid ejecting apparatus is inclined by an action of the gravitational force from a posture taken when ejecting the liquid, and a maintenance memory unit including a plurality of maintenance operations stored therein as maintenance operations to be performed on the ejection head, and configured to execute the maintenance operations for the ejection head, the maintenance method comprising:

storing the direction of movement of the movable member in response to abutment with the moved movable member;

determining the direction of movement of the moved movable member by acquiring the contents stored by the storing;

reading out a maintenance operation corresponding to the direction of movement of the moved movable member from a plurality of the maintenance operations stored in the maintenance memory unit; and executing the maintenance operation read out by the reading out on the ejection head.

* * * * *